US011599065B2

(12) United States Patent
Tombez

(10) Patent No.: US 11,599,065 B2
(45) Date of Patent: Mar. 7, 2023

(54) TIMEPIECE COMPRISING A MECHANICAL MOVEMENT WHEREIN THE WORKING IS REGULATED BY AN ELECTROMECHANICAL DEVICE

(71) Applicant: The Swatch Group Research and Development Ltd, Marin (CH)

(72) Inventor: Lionel Tombez, Bevaix (CH)

(73) Assignee: The Swatch Group Research and Development Ltd, Marin (CH)

( * ) Notice: Subject to any disclaimer, the term of this patent is extended or adjusted under 35 U.S.C. 154(b) by 945 days.

(21) Appl. No.: 16/427,405

(22) Filed: May 31, 2019

(65) Prior Publication Data

US 2019/0384228 A1 Dec. 19, 2019

(30) Foreign Application Priority Data

Jun. 19, 2018 (EP) ..... 18178547

(51) Int. Cl.
*G04C 11/08* (2006.01)
*G04C 3/04* (2006.01)

(52) U.S. Cl.
CPC ..... *G04C 11/084* (2013.01); *G04C 3/04* (2013.01)

(58) Field of Classification Search
CPC ..... G04C 3/04; G04C 11/084
See application file for complete search history.

(56) References Cited

U.S. PATENT DOCUMENTS 7,396,154 B2 * 7/2008 Houlon ..... G04C 5/005 368/127
7,686,503 B2 * 3/2010 Rochat ..... G04B 15/06 368/127

(Continued)

FOREIGN PATENT DOCUMENTS

EP 1 158 373 A1 11/2001
EP 1 164 441 A1 12/2001

(Continued)

OTHER PUBLICATIONS

Notice of the Reason for Refusal dated Apr. 13, 2021 in Japanese Patent Application No. 2019-109234 (with English language translation), 8 pages.

(Continued)

*Primary Examiner* — Edwin A. Leon
*Assistant Examiner* — Jason M Collins
(74) *Attorney, Agent, or Firm* — Oblon, McClelland, Maier & Neustadt, L.L.P.

(57) ABSTRACT

A timepiece includes a mechanical oscillator, formed of a mechanical resonator, and a device for regulating the frequency of the mechanical oscillator. This regulation device includes an auxiliary oscillator, an electromechanical device for stopping the mechanical resonator, a sensor arranged to detect the passage of the mechanical resonator via the neutral position thereof, and a measuring device arranged to measure a time drift of the mechanical oscillator. The regulation device is arranged to stop, during a given alternation, the natural oscillation movement of the mechanical resonator selectively either momentarily during a first half-alternation occurring before the passage of the mechanical resonator via the neutral position thereof when the time drift measured corresponds to at least a certain gain, or prematurely during a second half-alternation occurring after the passage of the mechanical resonator via the neutral position (Continued)

thereof when the time drift measured corresponds to at least a certain loss.

10 Claims, 6 Drawing Sheets

(56) References Cited

U.S. PATENT DOCUMENTS

| | | | | |
|---|---|---|---|---|
| 8,534,910 | B2 * | 9/2013 | Baudet | G04C 5/005 368/126 |
| 2003/0137901 | A1 * | 7/2003 | Tokoro | G04C 3/06 368/127 |
| 2005/0073913 | A1 * | 4/2005 | Born | G04C 10/00 368/127 |
| 2017/0045861 | A1 | 2/2017 | Winkler et al. | |
| 2018/0181073 | A1 | 6/2018 | Tombez et al. | |

FOREIGN PATENT DOCUMENTS

| | | | |
|---|---|---|---|
| EP | 1 241 538 | A1 | 9/2002 |
| EP | 3 339 982 | A1 | 6/2018 |
| FR | 2 162 404 | A1 | 7/1973 |
| JP | 48-66466 | A | 9/1973 |
| JP | 2017-37065 | A | 2/2017 |
| WO | WO 01/01204 | A1 | 1/2001 |
| WO | WO 01/65318 | A1 | 9/2001 |
| WO | WO 2018/177779 | A1 | 10/2018 |

OTHER PUBLICATIONS

Japanese Office Action dated Jul. 21, 2020 in Japanese Patent Application No. 2019-109234 (with English translation), 11 pages.
Combined Chinese Office Action and Search Report dated Sep. 27, 2020 in Chinese Patent Application No. 201910526655.5, 6 pages.
European Search Report dated Nov. 30, 2018 in European Application 18178547.8, filed on Jun. 19, 2018 (with English Translation of Categories of Cited Documents).

* cited by examiner

TIMEPIECE COMPRISING A MECHANICAL MOVEMENT WHEREIN THE WORKING IS REGULATED BY AN ELECTROMECHANICAL DEVICE

CROSS-REFERENCE TO RELATED APPLICATIONS

The present application claims priority to European Patent Application No. 18178547.8, filed on Jun. 19, 2018, which is incorporated by reference herein.

FIELD OF THE INVENTION

The present invention relates to a timepiece comprising:

a mechanism for indicating a temporal data item, a mechanical resonator suitable for oscillating along an oscillation axis about a neutral position corresponding to the minimum potential energy state thereof, a maintenance device of the mechanical resonator forming therewith a mechanical oscillator arranged to pace the working of the mechanism, each oscillation of the mechanical resonator having two successive alternations between two extreme positions, on the oscillation axis, which define the oscillation amplitude of the mechanical oscillator, each alternation having a first half-alternation occurring before the passage of the mechanical resonator via the neutral position thereof and a second half-alternation occurring after the passage of the mechanical resonator via the neutral position thereof, and a device for regulating the mean frequency of the mechanical oscillator, this regulation device comprising an auxiliary oscillator and a device arranged to apply on command regulation impulses to the mechanical resonator.

"Pacing the working of a mechanism" denotes pacing the movement of the mobile elements of this mechanism when operating, in particular determining the rotational speeds of the wheels thereof.

In particular, the mechanical resonator is a sprung balance and the maintenance device comprises a conventional escapement, for example a Swiss lever escapement. The auxiliary oscillator is formed particularly by a quartz resonator or by an integrated resonator in an electronic circuit.

TECHNOLOGICAL BACKGROUND

Those skilled in the art know timepiece mechanical movements with which a device for regulating the frequency of the sprung balance thereof which is of the electromechanical type is associated. More specifically, regulation takes place via a mechanical interaction between the sprung balance and the regulation device, the latter being arranged to act upon the oscillating balance by a system formed of a banking arranged on the balance and an actuator equipped with a mobile finger which is actuated at a braking frequency in the direction of the banking, without however touching the felloe of the balance. Such a timepiece is described in document FR 2.162.404. According to the concept proposed in this document, it is sought to synchronise the frequency of the mechanical oscillator with that of a quartz resonator by an interaction between the finger and the banking when the mechanical oscillator exhibits a time drift relative to a setpoint frequency, the finger being envisaged to be capable of either momentarily locking the balance which is then stopped in the movement thereof for a certain time interval (the banking bearing against the finger moved in the direction thereof upon a return of the balance towards the neutral position thereof), or limiting the oscillation amplitude when the finger arrives against the banking while the balance rotates in the direction of one of the two extreme angular positions thereof (defining the amplitude thereof), the finger then stopping the oscillation and the balance restarting directly in the opposite direction.

Such a regulation system has numerous drawbacks and it can seriously be doubted whether it can form a functional system. The periodic actuation of the finger relative to the oscillation movement of the banking and also a potentially large initial phase-shift, for the oscillation of the banking with respect to the periodic movement of the finger towards this banking, pose several problems. It will be noted that the interaction between the finger and the banking is limited to a single angular position of the balance, this angular position being defined by the angular position of the actuator relative to the axis of the sprung balance and the angular position of the banking on the balance at rest (defining the neutral position thereof). Indeed, the movement of the finger is envisaged to stop the balance by contact with the banking, but the finger is arranged not to come into contact with the felloe of the balance. Furthermore, it will be noted that the moment of an interaction between the finger and the banking is also dependent on the amplitude of the oscillation of the sprung balance.

It will be noted that the synchronisation sought seems improbable. Indeed, in particular for a sprung balance wherein the frequency is greater than the setpoint frequency pacing the to-and-fro motion of the finger and with a first interaction between the finger and the banking which momentarily retains the balance returning from one of the two extreme angular positions thereof (correction reducing the error), the second interaction, after numerous oscillations without the banking touching the finger during the alternating movement thereof, will be certainly a stoppage of the balance by the finger with immediate inversion of the oscillation direction thereof, in that the banking abuts against the finger while the balance rotates towards said extreme angular position (correction increasing the error). Thus, not only is there an uncorrected time drift during a time interval that may be long, for example several hundred oscillation periods, but some interactions between the finger and the banking increase the time drift instead of reducing it! It will be further noted that the phase-shift of the oscillation of the banking, and therefore of the sprung balance, during the abovementioned second interaction may be significant according to the relative angular position between the finger and the banking (balance in neutral position thereof).

It may thus be doubted that the synchronisation sought is obtained. Furthermore, in particular if the natural frequency of the sprung balance is similar but not equal to the setpoint frequency, scenarios where the finger is locked in the movement thereof towards the balance by the banking which is located at this time facing the finger are foreseeable. Such parasitic interactions may damage the mechanical oscillator and/or the actuator. Furthermore, this limits practically the tangential range of the finger. Finally, the holding time of the finger in the interaction position with the banking must be relatively short, therefore limiting a correction inducing a loss.

In conclusion, the operation of the timepiece proposed in document FR 2.162.404 appears to those skilled in the art to be highly improbable, deterring them from such a teaching.

SUMMARY OF THE INVENTION

An aim of the present invention is that of finding a solution to the technical problems and drawbacks of the prior art mentioned in the technological background.

Within the scope of the present invention, it is sought generally to enhance the working precision of a mechanical timepiece movement, i.e. to reduce the daily time drift of this mechanical movement. In particular, the present invention seeks to achieve such an aim for a mechanical timepiece movement wherein the working is initially optimally set. Indeed, a general aim of the invention is that of finding a device for correcting a time drift of a mechanical movement, namely a device for correcting the working thereof to enhance the precision thereof, without for all that relinquishing the ability to operate autonomously with the best possible precision that it can have owing to the inherent features thereof, i.e. in the absence of the correction device or when the latter is inactive.

To this end, the present invention relates to a timepiece as defined in the field of the invention and wherein the regulation device comprises an electromechanical device suitable for stopping during an alternation at least momentarily the oscillation movement of the mechanical resonator in the direction of this alternation, and a regulation circuit arranged to be able to generate a control signal intended for the electromechanical device to activate same. The regulation device further comprises a sensor, arranged to be able to detect the passage of the mechanical resonator via at least a certain given position on the oscillation axis, and a measuring device arranged to be able to measure, on the basis of a detection signal supplied by the sensor, a potential time drift of the mechanical oscillator relative to the auxiliary oscillator. The measuring device and the regulation circuit are arranged to be able to determine whether the time drift corresponds to at least a certain gain or to at least a certain loss. The regulation circuit and the electromechanical device are arranged to be able, when the mechanical resonator oscillates with an amplitude within a useful operating range, a) when the time drift measured corresponds to said at least a certain gain, to stop momentarily, during the first half-alternation of a given alternation, the oscillation movement of the mechanical resonator in the direction of this alternation, so as to prolong this first half-alternation relative to a nominal duration T0/4 envisaged for each natural half-alternation, and b) when the time drift measured corresponds to said at least a certain loss, to stop the oscillation movement of the mechanical resonator during the second half-alternation of at least a given alternation, in particular of a plurality of given alternations, so as to prematurely put an end to the second half-alternation of each given alternation, relative to the nominal duration T0/4, and to start the next alternation at a time occurring before this nominal duration has been attained since the last passage of the mechanical resonator via the neutral position thereof.

Owing to the features of the invention, it is possible to regulate reliably and effectively the working of the mechanical movement, whether the latter exhibits a time drift corresponding to a certain loss or to a certain gain.

In a main embodiment, the electromechanical device is formed by an actuator comprising a stopping member defining a mobile banking for a projecting part of the mechanical resonator, the stopping member being arranged mobile between a non-interaction position, where it is outside an area swept by the projecting part when the mechanical resonator oscillates with an amplitude in the useful operating range, and an interaction position where it is situated partially in this area swept by the projecting part. The stopping member may be actuated on command to stop, via the projecting part abutting against the stopping member then placed in the interaction position thereof, the oscillation movement of the mechanical resonator in the direction of the given alternation and selectively in the first half-alternation or the second half-alternation of this alternation according to whether, respectively, at least a certain gain or at least a certain loss has been detected.

Thus, in the main embodiment, firstly, the electromechanical device is arranged such that, when the stopping member is actuated to stop the mechanical resonator in a first half-alternation, the stopping member prevents momentarily, after the projecting part has abutted against this stopping member, the mechanical resonator from continuing the natural oscillation movement inherent to this first half-alternation, such that this natural oscillation movement during the first half-alternation is momentarily interrupted before it is continued, with a certain time phase-shift, after the removal of the stopping member. Furthermore, the electromechanical device is arranged such that, when the stopping member is actuated to stop the mechanical resonator in a second half-alternation, it thus prematurely puts an end to this second half-alternation without locking the mechanical resonator by inverting the direction of the oscillation movement of the mechanical resonator, such that this mechanical resonator starts, following an instantaneous or quasi-instantaneous stoppage induced by the collision of the projecting part with the stopping member, directly a next alternation.

BRIEF DESCRIPTION OF THE FIGURES

The invention will be described in more detail below with reference to the annexed drawings, given by way of non-limiting examples, wherein.

DETAILED DESCRIPTION OF THE INVENTION

Figure 1:
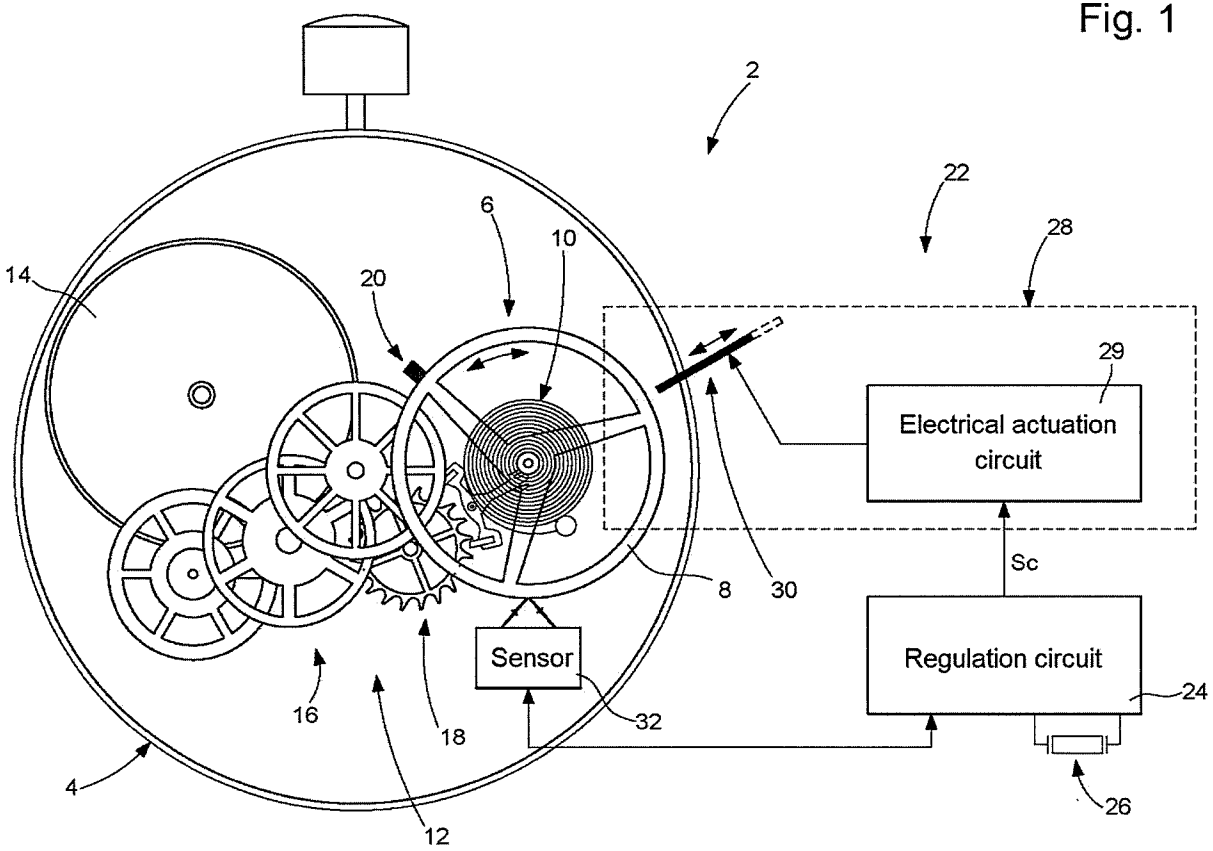
FIG. 1 is a partially schematic view of a main embodiment of a timepiece according to the invention.

With references to the annexed figures, a main embodiment of a timepiece 2 according to the invention will be described. It comprises a timepiece movement 4 and a regulation device 22 arranged to be able to induce phase-shifts in the oscillation movement of the mechanical resonator 6 arranged to pace the working of the timepiece 4.

The mechanical movement 4 includes at least one indicator mechanism 12 of a temporal data item, this mechanism comprising a train 16 actuated by a barrel 14. The mechanical resonator 6 is formed by a balance 8 and a balance-spring 10. The indicator mechanism 12 comprises a maintenance device of the mechanical resonator, this maintenance device being formed by an escapement 18. The escapement and the mechanical resonator forms a mechanical oscillator. The escapement conventionally comprises a pallet fork and an escape wheel, the latter being kinematically linked to the barrel by means of train 16. The mechanical resonator is suitable for oscillating about a neutral position (rest position/zero angular position), corresponding to the minimum potential energy state thereof, along a circular geometric axis, i.e. exhibiting an angular oscillation movement about rotational axis 9 of the balance. As the position of the balance is given by the angular position thereof, it is understood that the radius of the circular geometric axis is not important. Generally, the oscillation axis defines an oscillation direction indicating the nature of the movement of the mechanical resonator, which may be linear in a further specific embodiment. Each oscillation of the mechanical resonator has two successive alternations between two extreme positions on the oscillation axis, these extreme positions defining the oscillation amplitude of the mechanical oscillator from the neutral position.

The timepiece comprises a system for regulating the frequency of the mechanical oscillator, this regulation system being formed, on one hand, by a projecting part 20 arranged on the felloe of the balance 8 and, on the other, by a regulation device 22 comprising:

- an auxiliary oscillator 26 formed by a quartz resonator,
- an electromechanical device, formed by an actuator 28, which is suitable for stopping during an alternation at least momentarily the oscillation movement of the mechanical resonator 6 in the natural direction thereof during this alternation,
- a regulation circuit 24 associated with the auxiliary oscillator 26 and arranged to be able to generate a control signal $S_C$ intended for the actuator to activate same, and
- a sensor 32 arranged to be able to detect the passage of the mechanical resonator via at least a certain given angular position.

Figure 2:
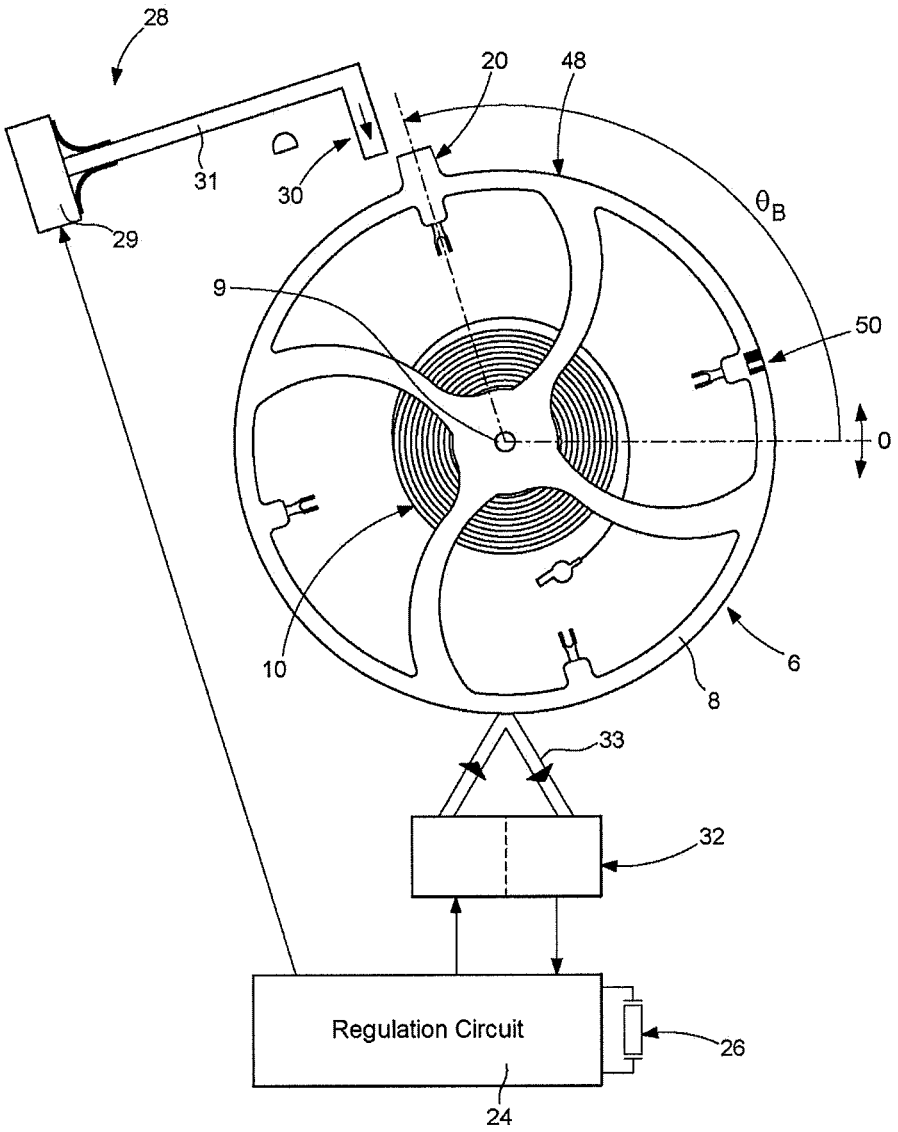
FIG. 2 shows the mechanical resonator of the timepiece in FIG. 1 and schematically the elements of the regulation device.
Figure 3:
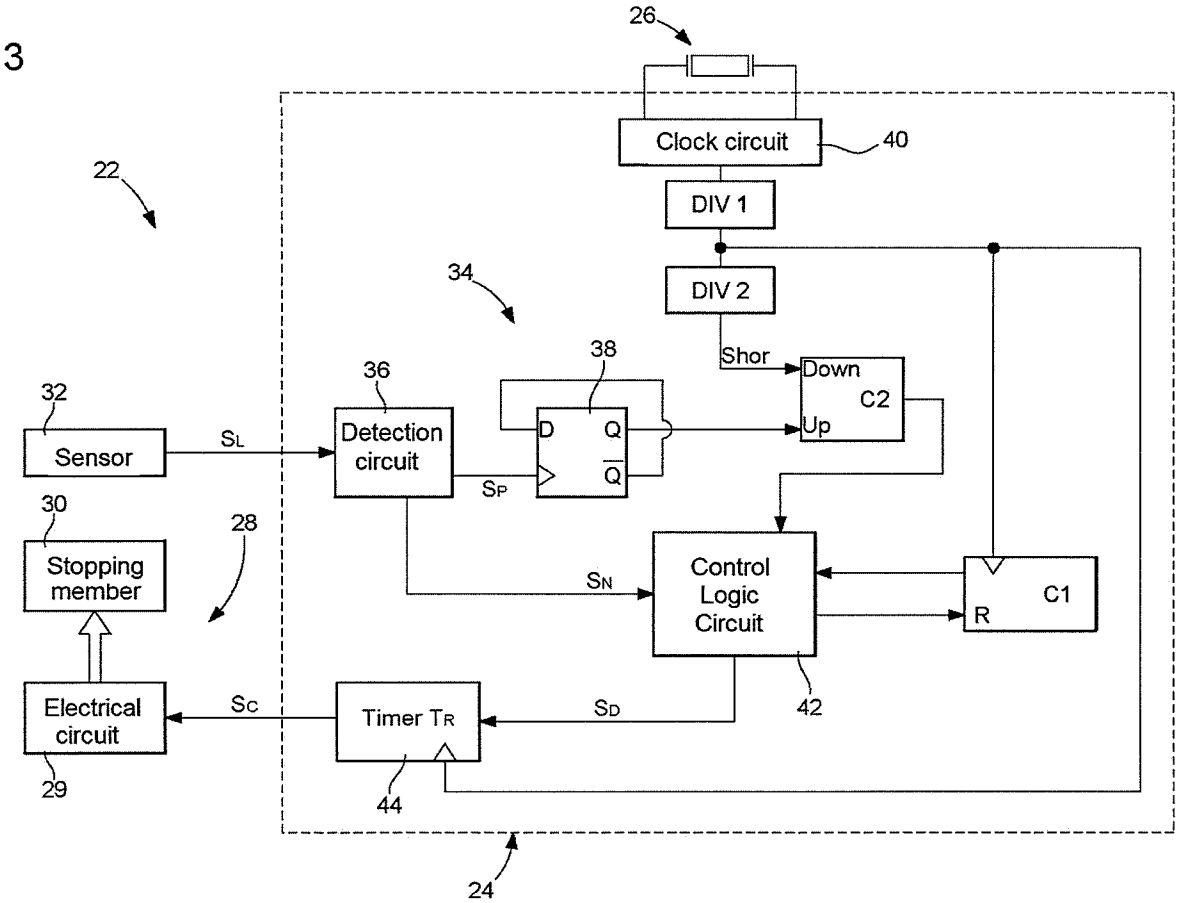
FIG. 3 shows the electrical diagram of the regulation circuit incorporated in the regulation device in FIG. 2, FIGS. 4A and 4B represent graphically the oscillation movement of the mechanical resonator in FIG. 3, in the case of a first interaction mode envisaged between the mechanical resonator and an actuator of the regulation device, for a correction of a certain loss, respectively of a certain gain detected in the working of the timepiece.

Actuator 28 comprises an electrical actuation circuit 29 and a stopping member 30 of the mechanical resonator which is formed by a mobile banking, which is defined in the alternative embodiment in FIG. 2 by a finger arranged at the end of a bar 31 made of piezoelectric material. This bar bends when an electric voltage is applied by electrical circuit 29 between two electrodes arranged on two opposite faces of the lateral faces thereof. Circuit 29 is connected to regulation circuit 24 which supplies thereto a control signal $S_C$ to actuate mobile banking 30 towards the felloe of the balance without however touching same. In a further embodiment, the actuator comprises an electromagnetic system arranged to be able move on command the stopping member between an interaction position with the projecting part 20 and a non-interaction position. This electromagnetic system may be formed by a fixed coil and a magnet place on a flexible bar bearing a finger defining the banking, or conversely. Alternatively, the mobile banking may be formed by a ferromagnetic material code entering inside a coil, which moves the central axis thereof when powered (a return spring is for example associated with the core).

In the alternative embodiment shown, sensor 32 is an optical sensor comprising a light source, arranged so as to be able to send a light beam towards the felloe of the balance wherein lateral surface 48 is reflective (particularly polished), and a light detector arranged to receive in return a light signal 33 reflected by the lateral surface. The optical sensor is envisaged herein to detect the passage of the mechanical resonator via the neutral position thereof and also to detect the direction of the oscillation movement so as to determine the alternation of the oscillation, of the two alternations defining each oscillation period, wherein this detection occurs. For this purpose, it is envisaged to vary the intensity of detected optical signal $S_L$ according to the angular position of the mechanical resonator. More specifically, lateral surface 48 comprises a marking 50 (shown in FIG. 2 on the felloe for the purposes of the disclosure of the detection) consisting of two absorbent zones of different widths. For example, the passage via zero is defined by the inner line (relative to the pattern formed of the two absorbent zones) of the widest zone. It is understood that the different widths of the two absorbent zones make it possible to easily determine the direction of rotation of balance 8. Detection circuit 36 arranged in regulation circuit 24, on one hand, detects the passage of the marking in front of the sensor and supplies a signal $S_P$ to a lever 38 of a measuring device 34 and, on the other detects the direction of the oscillation of the balance following detection of the passage of the marking opposite the sensor and supplies a signal $S_N$ to a control logic circuit 42 relative to the current alternation.

It will be noted that signal $S_N$ may indicate for each detection of the marking the direction of oscillation to logic circuit 42 or indicate thereto merely when a predefined alternation per oscillation period is in progress, given that the interaction between the actuator and the balance is envisaged herein merely between the passage of the balance via the neutral position in a predefined alternation, selected from the first alternation and the second alternation of an oscillation period, and the passage of this balance via the neutral position of the following alternation, as will be understood clearly hereinafter in the description of the invention. It will be noted therefore that, in one alternative embodiment, lever 38 may be removed as the detection circuit can easily transmit a single impulse per oscillation period via signal $S_P$. In a further alternative embodiment, there is envisaged either a capacitive sensor, or an inductive sensor arranged to be able to detect a variation of capacitance, respectively inductance according to the angular position of the mechanical resonator. Concerning the electrical power supply of the regulation device, there is envisaged a power source associated with a device for storing the electrical energy generated by the power source. The power source is for example formed by a photovoltaic cell or by a thermoelectric element, these examples being non-limiting. In the case of a battery, the power source and the storage device form a single electric component together.

Figure 6:
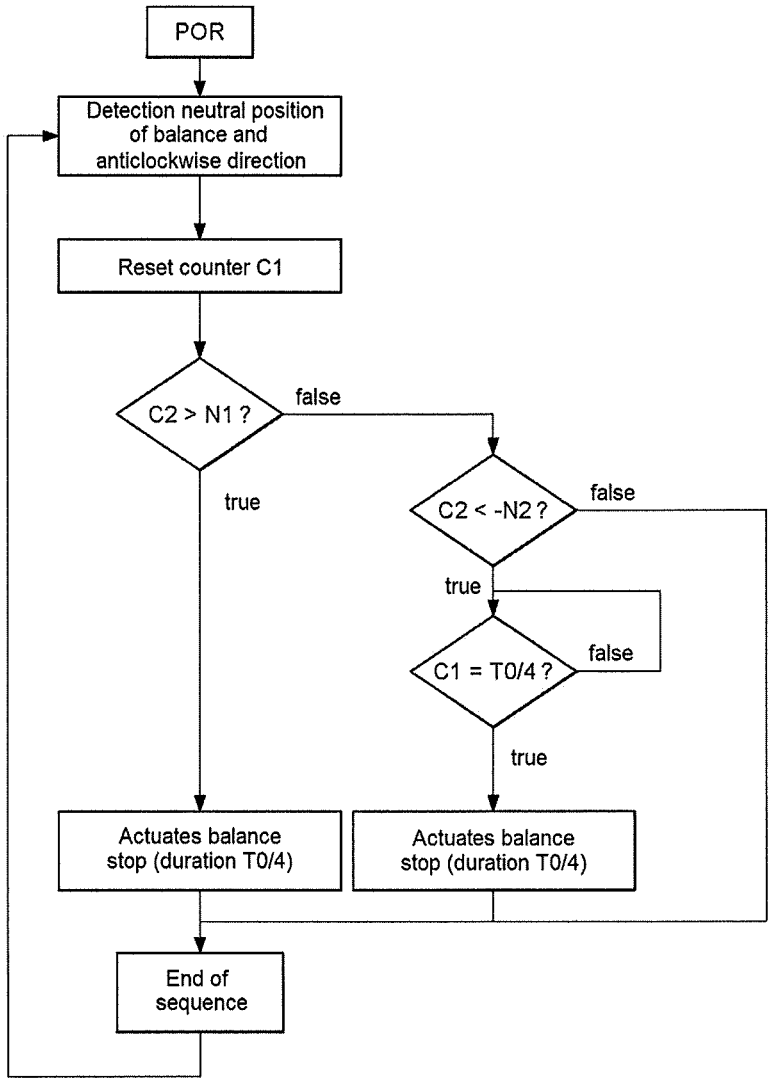
FIG. 6 is a flow chart describing an operating mode of the regulation device of the main embodiment.

Then, the regulation device comprises a measuring device 34 arranged to be able to measure, based on a detection signal $S_L$ supplied by sensor 32, a time drift of the mechanical oscillator relative to auxiliary oscillator 26. The measuring device is formed from detection circuit 36 previously described, a lever 38 and a bidirectional counter C2 which receives at one of the two inputs thereof signal $S_P$, which supplies an impulse per oscillation period detected using the sensor, and at the other of the inputs thereof a clock signal $S_{hor}$ generated by auxiliary oscillator 26 wherein clock circuit 40 supplies a reference signal to a divisor having two stages DIV1 and DIV2. The first stage of the divisor supplies a frequency signal to a time counter C1 and to a timer 44. The status of counter C2 thus gives the time drift of mechanism 12 in absolute values from the activation of the regulation device. The status of counter C2 is supplied to control logic circuit 42 which is arranged to be able to determine whether the time drift corresponds to at least a certain gain or to at least a certain loss, by a comparison with reference values N1 and N2, as shown in FIG. 6.

Generally, according to the invention, regulation circuit 24 and actuator 28 are arranged to be able to stop during at least a given alternation, when the mechanical resonator oscillates with an amplitude within a useful operating range, the oscillation movement of the mechanical resonator in the direction of this given alternation and selectively either during a first half-alternation of a given alternation, occurring before the passage of the mechanical resonator via the neutral position thereof in this given alternation, when the time drift measured corresponds to at least a certain gain; or during a second half-alternation of at least a given alternation, occurring after the passage of the mechanical resonator via the neutral position thereof in this given alternation, when the time drift measured corresponds to at least a certain loss. In the latter case, the oscillation movement is stopped in such a way as to prematurely put an end to each second half-alternation, relative to the nominal duration of a natural half-alternation, and to begin the next alternation at a time occurring before this nominal duration is reached since the last passage of the mechanical resonator by the neutral position thereof. To do this, in the embodiment described here, stopping member 30 of actuator 28 defines a mobile banking for a projecting part 20 of the mechanical resonator. It will be noted that, preferably, the balance is designed so as to be balanced.

The stopping member is arranged mobile between a non-interaction position, where it is outside an area swept by the projecting part when the mechanical resonator oscillates with an amplitude in the useful operating range, and an interaction position where it is situated partially in this area swept by the projecting part to thus be able to stop balance 8 in the direction of the oscillation movement thereof when projecting part 20 abuts against the stopping member. Stopping member 30 (which is mobile along a substantially radial movement axis) is positioned angularly, relative to the oscillation axis of the balance, so that it has, when in the interaction position thereof, an angular lag $\theta_B$ different to zero with projecting part 20 of the balance when the mechanical resonator is in the neutral position thereof, which corresponds in FIG. 2 to a positioning of projecting part 20 at an angular position '0'. This angular position is detected by sensor 32 via marking 50, which is presented opposite this sensor then the projecting part is positioned at the zero angle. Angular lag $\theta_B$ is envisaged less than the minimum amplitude of the useful operating range of the mechanical oscillator so as to enable a correction of a time drift throughout this useful operating range. For example, the value of the angular lag is situated between 60° and 150°, preferably between 90° and 120°.

According to the invention, as previously indicated, it is envisaged to actuate on command stopping member 30 to stop balance 8 during a first half-alternation or during at least a second half-alternation according to whether, respectively, at least a certain gain or at least a certain loss has been detected. There will be described hereinafter, with reference to FIGS. 4A to 6, two interaction modes (FIGS. 4A,4B; FIGS. 5A,5B) envisaged between the stopping member (mobile banking) and the projecting part of the balance to regulate the frequency of the mechanical oscillator and therefore the working of the timepiece movement, by generating selectively a positive phase-shift in the oscillation of the balance to correct a certain loss (FIGS. 4A, 5A) and a negative phase-shift to correct a certain gain (FIGS. 4B, 5B).

In FIGS. 4A to 5B is shown angular position θ of balance 8 as a function of time. As indicated in FIG. 6, when the sensor detects a passage of the balance via the neutral position thereof and an anticlockwise direction of the oscillation movement (anticlockwise direction for the alternative embodiment represented given that herein the interaction between the stopping member and the projecting part can only occur after a passage of this projecting part via angle '0' in the anticlockwise direction), logic circuit 42 resets time counter C1 and detects whether bidirectional counter C2 exhibits at least a certain gain, i.e. C2>N1, or at least a certain loss, i.e. C2<−N2; where N1 and N2 are natural numbers greater than zero.

Each natural oscillation period T0 of the mechanical oscillator comprises a first natural alternation A1, of nominal duration T0/2 (oscillation movement in a first direction between two extreme angular positions of the mechanical resonator), and a second natural alternation A2 (oscillation movement in the opposite direction of the first direction between the two extreme angular positions) of the same nominal duration T0/2. First natural alternation A1 consists of a first half-alternation $D1_1$, of nominal duration T0/4 and occurring before the passage of the mechanical resonator via the neutral position thereof (angular position '0'), and a second half-alternation $D2_1$ of the same nominal duration T0/4 and occurring after the passage of the mechanical resonator via the neutral position thereof. Similarly, the second natural alternation A2 consists of a first half-alternation $D1_2$, of nominal duration T0/4 and occurring before the passage of the mechanical resonator via the neutral position thereof, and a second half-alternation $D2_2$ of the same nominal duration T0/4 and occurring after the passage of the mechanical resonator via the neutral position thereof.

Figure 4A:
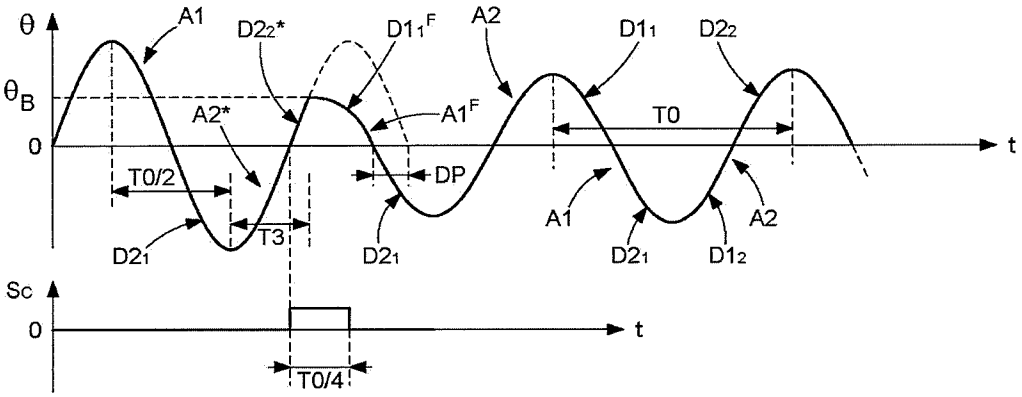
Figure 4B:
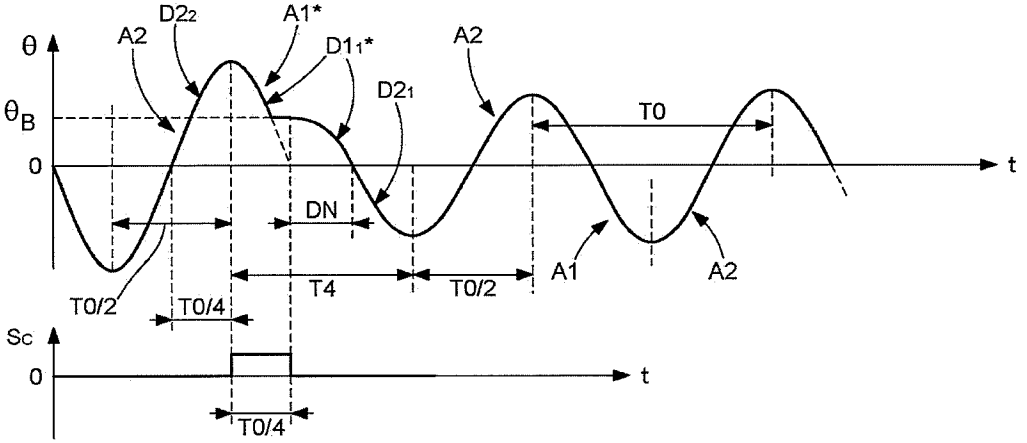
Figure 5A:
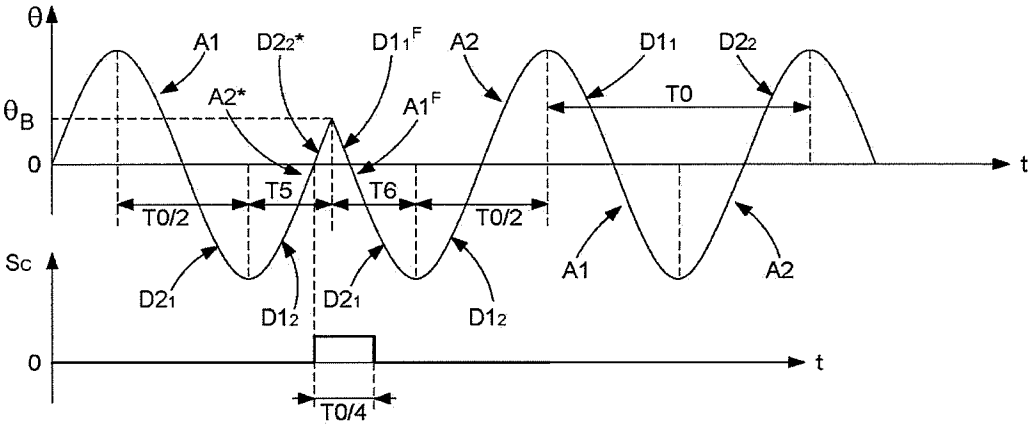
FIGS. 5A and 5B are similar graphs to those in FIGS. 4A and 4B in the case of a second interaction mode envisaged between the mechanical resonator and an actuator of the regulation device.
Figure 5B:
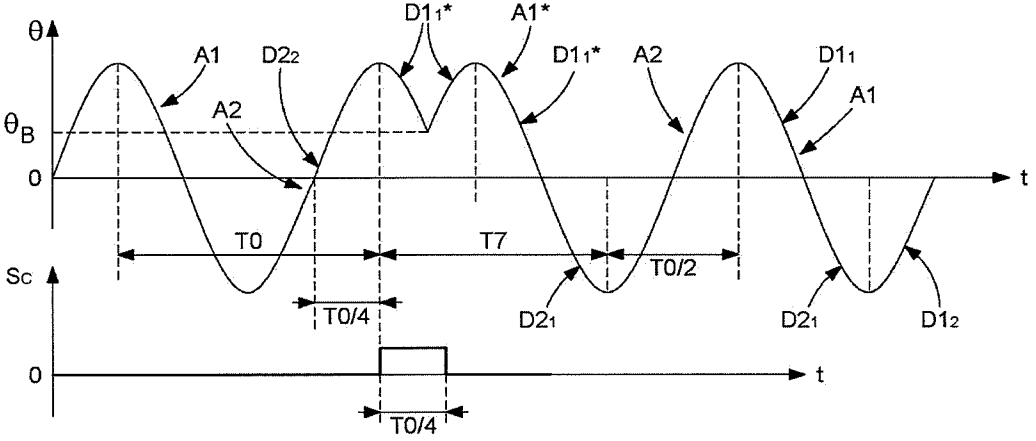

In FIG. 4A, the regulation device makes a correction following the detection of a certain loss. To this end, during a second alternation A2*, the stopping member is actuated directly after the detection of the passage of the balance via the neutral position thereof (signal $S_C$), for a duration T0/4 corresponding to that of a half-alternation, to stop the mechanical resonator during second half-alternation $D2_2$* of second alternation A2*, i.e. after the passage via the neutral position and before attaining the extreme angular position of the natural oscillation (undisturbed oscillation). To do this, after control logic circuit 42 has received from detection circuit 36, via signal $S_N$, the information that a second half-alternation of an alternation in the anticlockwise direction is starting, this logic circuit 42 generates a signal $S_D$ for triggering a timer 44 which is arranged so as to supply, following the reception of the triggering signal, a control circuit $S_C$ to electrical circuit 29 of actuator 28 to activate the latter during time interval $T_R$ equal to T0/4 in the alternative embodiment described herein. Thus, the stopping member 30 is actuated and placed in the interaction position thereof during time interval $T_R$. It results from this action that projecting part 20 of the balance abuts against the stopping member during the second half-alternation in question when the projecting part of the balance reaches angular position $\theta_B$. This event puts an end prematurely to this second half-alternation by inverting the direction of the oscillation movement of the mechanical resonator without locking same, such that this mechanical resonator then starts directly a next alternation $A1^F$. Thus, a positive phase-shift DP is obtained, as shown in the graph in FIG. 4A, and the duration of alternation A2* equals T3, this value being less than nominal value T0/2. This positive phase-shift makes it possible to compensate a certain loss. It will be noted that this correction action is generally performed successively in a plurality of oscillation periods or alternations according to the loss detected.

In FIG. 4B, the regulation device makes a correction following the detection of a certain gain. To this end, during a first alternation A1*, the stopping member is actuated after a time delay of T0/4 following the detection of the balance via the neutral position, for a duration T0/4 corresponding to that of a half-alternation, to thus stop the mechanical resonator during first half-alternation $D1_1$* of first alternation A1*, i.e. between the extreme angular position of the natural oscillation ending preceding natural alternation A2 and the passage via the neutral position of the mechanical resonator during first alternation A1*. To do this, after control logic circuit 42 has received from detection circuit 36, via signal $S_N$, the information that a second half-alternation of an alternation (anticlockwise direction) is starting, this logic circuit 42 resets time counter C1 and wait until the latter measures a time interval equal to T0/4. Then, it generates a signal $S_D$ to trigger timer 44 which then supplies a control signal $S_C$ to electrical circuit 29 of actuator 28 to activate the latter during a time interval $T_R$ equal to T0/4 in the alternative embodiment described herein. In a further alternative embodiment, it will be noted that this time interval may be envisaged as much longer to make a greater correction. In a specific alternative embodiment, the duration of this time interval may be varied according to different values detected for the gain of the mechanical oscillator.

Thus, at the end of the time delay which enables current natural alternation A2 to end, stopping member 30 is actuated substantially at the start of alternation A1* and placed in the interaction position thereof for time interval $T_R$. It results from this action that projecting part 20 of the balance abuts against the stopping member during the first half-alternation in question when the projecting part of the balance attains angular position $\theta_B$ towards the neutral position. This event stops the balance and the stopping member momentarily locks the mechanical resonator such that first half-alternation $D1_1$* is momentarily interrupted before it is continued. A negative phase-shift DN is thus obtained, as shown in the graph in FIG. 4B, and the duration of alternation A1* equals T4, this value being greater than nominal value T0/2. This negative phase-shift makes it possible to compensate a certain gain. This correction action may be performed successively in a plurality of oscillation periods according to the loss detected.

In the first interaction mode in FIGS. 4A and 4B, when the stopping member puts an end to a second half-alternation to correct a loss, it absorbs substantially the kinetic energy of the sprung balance, such that next first half-alternation $D1_1^F$ starts with a substantially zero speed and has substantially a nominal duration T0/4. Thus, alternation $A1^F$ has substantially a nominal duration T0/2 and a lesser amplitude, which is dependent on the angular lag $\theta_B$. In the case of gain correction, the interrupted alternation is continued following the removal of the stopping member by a resumption alternation having a lesser amplitude and substantially a nominal duration T0/2. The amplitude of this resumption alternation is substantially equal to that of alternation $A1^F$.

In FIGS. 5A and 5B is represented the angular position of the balance during an interaction with the stopping member in the case of a second interaction mode to correct respectively a loss and a gain in the working of the timepiece movement. Whereas in the first interaction mode, the kinetic energy of the mechanical resonator is absorbed by the actuator, the stopping member and the projecting part of the balance are arranged in the second interaction mode so as to exhibit therebetween, when the stopping member is placed on command in the interaction position thereof, an elastic shock to stop the oscillation movement of the mechanical resonator in the natural direction of the alternation in question, the stoppage thus induced being instantaneous or quasi-instantaneous and an inversion of the direction of the oscillation movement occurring with a certain kinetic energy restored to the mechanical resonator by the stopping member following the instantaneous or quasi-instantaneous stoppage of this mechanical resonator. It will be noted that the 'quasi-instantaneous' alternative mentioned indicates that practically the stoppage may have a very short duration even if no specific member locks the balance. Thus, the stoppage (zero speed) may have a few milliseconds before the balance starts again in the opposite direction.

In FIG. 5A where a positive phase-shift is generated as in FIG. 4A to correct at least partially a loss, it is seen that first half-alternation $D1_1^F$ following the elastic stopping of the balance has a significantly reduced duration, the value thereof being substantially equal to that of second half-alternation $D2_2$* during which the stoppage of the balance occurred. It results from this situation that duration T6 of alternation $A1^F$ is substantially equal to reduced duration T5 of alternation A2*, such that the positive phase-shift generated in the oscillation of the mechanical resonator is herein greater than that obtained in the case of FIG. 4A.

In FIG. 5B where a negative phase-shift is generated as in FIG. 4B to correct a gain, it is seen that first half-alternation $D1_1$* during which the stoppage of the mechanical resonator occurs is greatly disturbed in that the elastic shock induces an angular recoil movement, in the opposite direction of that of a first natural alternation A1, such that alternation A1* has after the elastic shock an angular path greater than that of a natural alternation and therefore a total duration T7 considerably greater than nominal duration T0/2 and greater than duration T4 (FIG. 4B). Thus, the negative phase-shift obtained herein is greater than that obtained in the case of FIG. 4B.

Finally, it will be noted that the projecting part of the balance may be arranged differently in further alternative embodiments. Thus, in a particular alternative embodiment, the projecting part is arranged below the felloe axially, the stopping member being mobile in a geometric plane situated below that of the balance and traversed by the projecting part. Further alternative embodiments may be envisaged by those skilled in the art while remaining within the scope of the present invention. In particular, further mechanical resonators may be envisaged. In various alternative embodiments, further electromechanical devices suitable for stopping the mechanical resonator during a first half-alternation and a second half-alternation may be arranged in the timepiece.

The invention claimed is:

1. A timepiece, comprising:

a mechanism for indicating a temporal data item;

a mechanical resonator suitable for having an oscillation movement along a given oscillation axis about a neutral position corresponding to a minimum potential energy state thereof;

a maintenance device of the mechanical resonator, the maintenance device and the mechanical resonator form a mechanical oscillator arranged to pace the working of said mechanism, each oscillation of the mechanical resonator having two successive alternations between two extreme positions, on the oscillation axis, which define the oscillation amplitude of the mechanical oscillator from the neutral position, each alternation having a first half-alternation and a second half-alternation occurring respectively before and after the passage of the mechanical resonator via the neutral position; and a device for regulating the mean frequency of the mechanical oscillator, the regulation device comprising an auxiliary oscillator, an electromechanical device suitable for stopping during an alternation at least momentarily the oscillation movement of the mechanical resonator in a direction of the alternation, and a regulation circuit arranged to be able to generate a control signal intended for the electromechanical device to activate same, wherein the regulation device comprises a sensor, arranged to be able to detect the passage of the mechanical resonator via at least a certain given position on the oscillation axis, and a measuring device arranged to be able to measure, on the basis of a detection signal supplied by the sensor, a potential time drift of the mechanical oscillator relative to the auxiliary oscillator, wherein the measuring device and the regulation circuit are arranged to be able to determine whether the time drift corresponds to at least a certain gain or to at least a certain loss; and wherein the regulation circuit and the electromechanical device are arranged to be able, when the mechanical resonator oscillates, a) when the time drift measured corresponds to said at least a certain gain, to stop momentarily, during the first half-alternation of a given alternation, the oscillation movement of the mechanical resonator in the direction of the first half-alternation, so as to prolong the first half-alternation relative to a nominal duration envisaged for each natural half-alternation, and b) when the time drift measured corresponds to said at least a certain loss, to stop the oscillation movement of the mechanical resonator during the second half-alternation of at least a given alternation so as to prematurely put an end to the second half-alternation, relative to said nominal duration, and to start a next alternation at a time occurring before the nominal duration has been attained since the last passage of the mechanical resonator via the neutral position thereof.

2. The timepiece according to claim 1, wherein the electromechanical device is formed by an actuator comprising a stopping member defining a mobile banking for a projecting part of the mechanical resonator, the stopping member being arranged mobile between a non-interaction position, where the stopping member is outside an area swept by the projecting part when the mechanical resonator oscillates, and an interaction position where the stopping member is situated partially in the area swept by the projecting part; and wherein the stopping member may be actuated on command to stop, via the projecting part abutting against the stopping member then placed in the interaction position thereof, the oscillation movement of the mechanical resonator in the direction of the given alternation and selectively in the first half-alternation or the second half-alternation of the given alternation according to whether, respectively, at least a certain gain or at least a certain loss has been detected.

3. The timepiece according to claim 2, wherein the electromechanical device is arranged such that, when the stopping member is actuated to stop the mechanical resonator in a first half-alternation, the stopping member locks momentarily the mechanical resonator, such that the oscillation movement during the first half-alternation is momentarily interrupted before the oscillation movement is continued after removing the stopping member, and such that, when the stopping member is actuated to stop the mechanical resonator in a second half-alternation, the stopping member prematurely puts an end to the second half-alternation without locking the mechanical resonator by inverting the direction of the oscillation movement of the mechanical resonator, so that the mechanical resonator then directly starts a next alternation, following an instantaneous or quasi-instantaneous stoppage of the mechanical resonator induced by a shock of the projecting part against the stopping member.

4. The timepiece according to claim 3, wherein, when the stopping member puts an end to a second half-alternation, the stopping member absorbs substantially the kinetic energy of the mechanical resonator such that the next alternation is started with a substantially zero speed.

5. The timepiece according to claim 2, wherein said stopping member and said projecting part of the mechanical resonator are arranged so as to exhibit therebetween, when the stopping member is placed on command in the interaction position thereof, a substantially elastic shock to stop the oscillation movement of the mechanical resonator in the direction of the given alternation, the stoppage thus induced being instantaneous or quasi-instantaneous and an inversion of the direction of the oscillation movement occurring with a certain kinetic energy restored to the mechanical resonator by the stopping member following the instantaneous or quasi-instantaneous stoppage of the mechanical resonator.

6. The timepiece according to claim 2, wherein the actuator comprises a piezoelectric element or an electromagnetic system arranged to be able to move on command the stopping member between the interaction and non-interaction positions thereof.

7. The timepiece according to claim 2, wherein the sensor is arranged to detect at least the passage of the mechanical resonator via the neutral position thereof; and wherein the regulation circuit is arranged such that, when at least a certain loss is detected, the regulation circuit sends a control signal to the electromechanical device after a detection of a passage of the mechanical resonator via the neutral position thereof so that the electromechanical device actuates the stopping member by placing the stopping member in the interaction position thereof for a duration substantially equal to the nominal duration of a natural half-alternation.

8. The timepiece according to claim 7, wherein said regulation circuit comprises a time counter and is arranged so as to be able, when at least a certain gain is detected, to reset the time counter after detection of a passage of the mechanical resonator via the neutral position thereof to measure a time delay period before sending the control signal to the electromechanical device so that the electromechanical device actuates the stopping member thereof by placing the stopping member in the interaction position thereof for a predefined or determined duration.

9. The timepiece according to claim 2, wherein said mechanical resonator is formed by a balance and a balance-spring, the balance bearing said projecting part; and wherein said stopping member is positioned angularly, relative to the oscillation axis of the balance, so that the stopping member has, when in the interaction position thereof, an angular lag different to zero with the projecting part when the mechanical resonator is in the neutral position thereof, the angular lag being less than the minimum amplitude of an operating range of the mechanical resonator.

10. The timepiece according to claim 1, wherein the sensor is either an optical sensor comprising a light source, arranged so as to be able to send a light beam towards the mechanical resonator, and a light detector arranged to receive in return a light signal the intensity whereof varies according to the position of the mechanical resonator along said oscillation axis, or a capacitive sensor or an inductive sensor arranged to be able to detect a variation of capacitance, respectively inductance according to the position of the mechanical resonator along said oscillation axis.

* * * * *